US007412786B1

(12) United States Patent
Stewart

(10) Patent No.: US 7,412,786 B1
(45) Date of Patent: Aug. 19, 2008

(54) SNOW MOWER BLADE

(76) Inventor: Bartlett H. Stewart, 7721 Shannon Lakes Way, Indianapolis, IN (US) 46217

( * ) Notice: Subject to any disclaimer, the term of this patent is extended or adjusted under 35 U.S.C. 154(b) by 437 days.

(21) Appl. No.: 11/178,578

(22) Filed: Jul. 12, 2005

(51) Int. Cl.
*E01H 5/09* (2006.01)

(52) U.S. Cl. ..... 37/243; 37/233

(58) Field of Classification Search ..... 37/233, 37/242, 243; 56/17.5, 255, 295, DIG. 17, 56/DIG. 19, DIG. 20; 15/79.1, 79.2, 78
See application file for complete search history.

(56) References Cited

U.S. PATENT DOCUMENTS 1,941,872 A * 1/1934 Abert ..... 138/174
2,863,162 A * 12/1958 Draughon ..... 15/79.2
2,983,057 A * 5/1961 Erickson ..... 37/243
2,991,567 A * 7/1961 Erickson ..... 37/243
3,048,869 A * 8/1962 Beatty ..... 15/78
3,051,972 A * 9/1962 Lacy ..... 15/79.1
3,061,480 A * 10/1962 Zink et al. ..... 134/6
3,142,913 A * 8/1964 Jacob ..... 37/243
3,724,182 A * 4/1973 Long et al. ..... 56/10.4
3,775,878 A * 12/1973 Beckner ..... 37/233
3,982,337 A * 9/1976 Garriott ..... 37/233

* cited by examiner

*Primary Examiner*—Thomas B Will
*Assistant Examiner*—Jamie L McGowan

(57) ABSTRACT

A snow mower blade, the blade for use with a rotary type lawn mower having a wheeled housing for movement over a surface of operation, the blade comprising an elongated horizontal, with an angle at each end of the horizontal, a pair of upwardly projecting spaced apart removable wipers disposed on the horizontal, a substantially vertical paddle plate at each end of each angle, a removable flexible paddle extending downwardly therefrom toward the surface of operation.

2 Claims, 4 Drawing Sheets

SNOW MOWER BLADE

BACKGROUND OF THE INVENTION

A snow blower is an expensive but often necessary piece of equipment. Conversion of a typical rotary lawn mower into a snow blower and ice and snow scraper is therefore a viable concept. A few problems must be overcome though. First, the conversion of the lawn mower should be reversible. A device that removably attaches to a mower is therefore a feasible concept. Further, the device should have the ability to scrape snow and ice from surfaces from which snow is being blown, even irregular surfaces. Replaceable contacts materials are therefore desirable as wear will no doubt occur. Contact materials should also be sufficiently flexible in order that surfaces are not scarred. Also, the replacement device should prevent accumulation of snow and ice within the blade housing of a lawn mower. Further, the device should be able to lift snow from a surface. The present invention accomplishes the desired goals while overcoming the problems inherent in doing so.

FIELD OF THE INVENTION

The present invention relates to snow blowers and more specifically to a snow mower blade for temporarily converting a lawn mower into a snow blower and ice scraper.

SUMMARY OF THE INVENTION

The general purpose of the snow mower blade, described subsequently in greater detail, is to provide a snow mower blade for converting a rotary lawn mower into a snow blower which has many novel features that result in an improved snow mower blade which is not anticipated, rendered obvious, suggested, or even implied by prior art, either alone or in combination thereof.

The invention is for use with a rotary type lawn mower having a wheeled housing for movement over a surface of operation. A typical lawn mower has a side discharge chute emanating from a wheeled housing. A motor is typically mounted on the housing. A crankshaft extends into the housing. A deck is on the underside of the housing. The invention removably mounts on a lower end of the crankshaft of the motor via the crankshaft mount of the invention. The crankshaft mount is an orifice for receiving a bolt that bolts to the crankshaft of the motor. The invention comprises an elongated horizontal that is coplanar to the deck of the mower. An angle is fixedly disposed at each end of the horizontal.

The angle smoothly transitions the horizontal into a vertical end. The angle thereby assists in lifting snow from the surface to be cleared. The pair of flexible spaced apart aerodynamic wipers is mounted atop the horizontal. The wipers extend upwardly therefrom. Each wiper has a length and a width. Each wiper is comprised of cloth-impregnated rubber. Each wiper is disposed between the mount and the angle. The length of each wiper is at an angle to the horizontal. Each wiper comprises a plurality of rounded ribs. The ribs are parallel to the width of the wiper. Each wiper is further comprised of a plurality of indentions. Each indention is parallel to the width of the wiper. Each indention separates two ribs. The wipers aerodynamically remove snow from the deck of the mower so that snow and ice do not build up within the mower's wheeled housing. A pair of vertically mounted paddle plates is provided. Each paddle plate is affixed to the vertical end of each angle. Each paddle has a first side and a second side. A portion of the first side is mounted against the paddle plate. The paddle extends downwardly therefrom toward the surface of operation. A clamp plate is affixed to the second side of the paddle. A plurality of removable fasteners removably holds the paddle between the clamp plate and the paddle plate. The paddles and the wipers are comprised of a cloth impregnated rubber.

The rotation of the snow mower blade within a housing of a typical rotary mower clears snow from surfaces. Snow within the housing of the mower is aerodynamically prevented from accumulating on the deck of the mower by wipers that are mounted on the upper side of the invention. Snow is ejected out of the chute of a lawn mower.

Thus has been broadly outlined the more important features of the snow mower blade so that the detailed description thereof that follows may be better understood and in order that the present contribution to the art may be better appreciated.

Numerous objects, features and advantages of the snow mower blade will be readily apparent to those of ordinary skill in the art upon reading the following detailed description of presently preferred, but nonetheless illustrative, examples of the snow mower blade when taken in conjunction with the accompanying drawings. In this respect, before explaining the current examples of the snow mower blade in detail, it is to be understood that the invention is not limited in its application to the details of construction and arrangements of the components set forth in the following description or illustration. The invention is capable of other examples and of being practiced and carried out in various ways. It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the snow mower blade. It is therefore important that the claims be regarded as including such equivalent constructions insofar as they do not depart from the spirit and scope of the present invention.

Objects of the snow mower blade, along with various novel features that characterize the invention are particularly pointed out in the claims forming a part of this disclosure. For better understanding of the snow mower blade, its operating advantages and specific objects attained by its uses, refer to the accompanying drawings and description.

DETAILED DESCRIPTION OF THE DRAWINGS

With reference now to the drawings, and in particular FIGS. 1 through 4 thereof, example of the snow mower blade employing the principles and concepts of the present invention and generally designated by the reference number 10 will be described.

Figure 3:
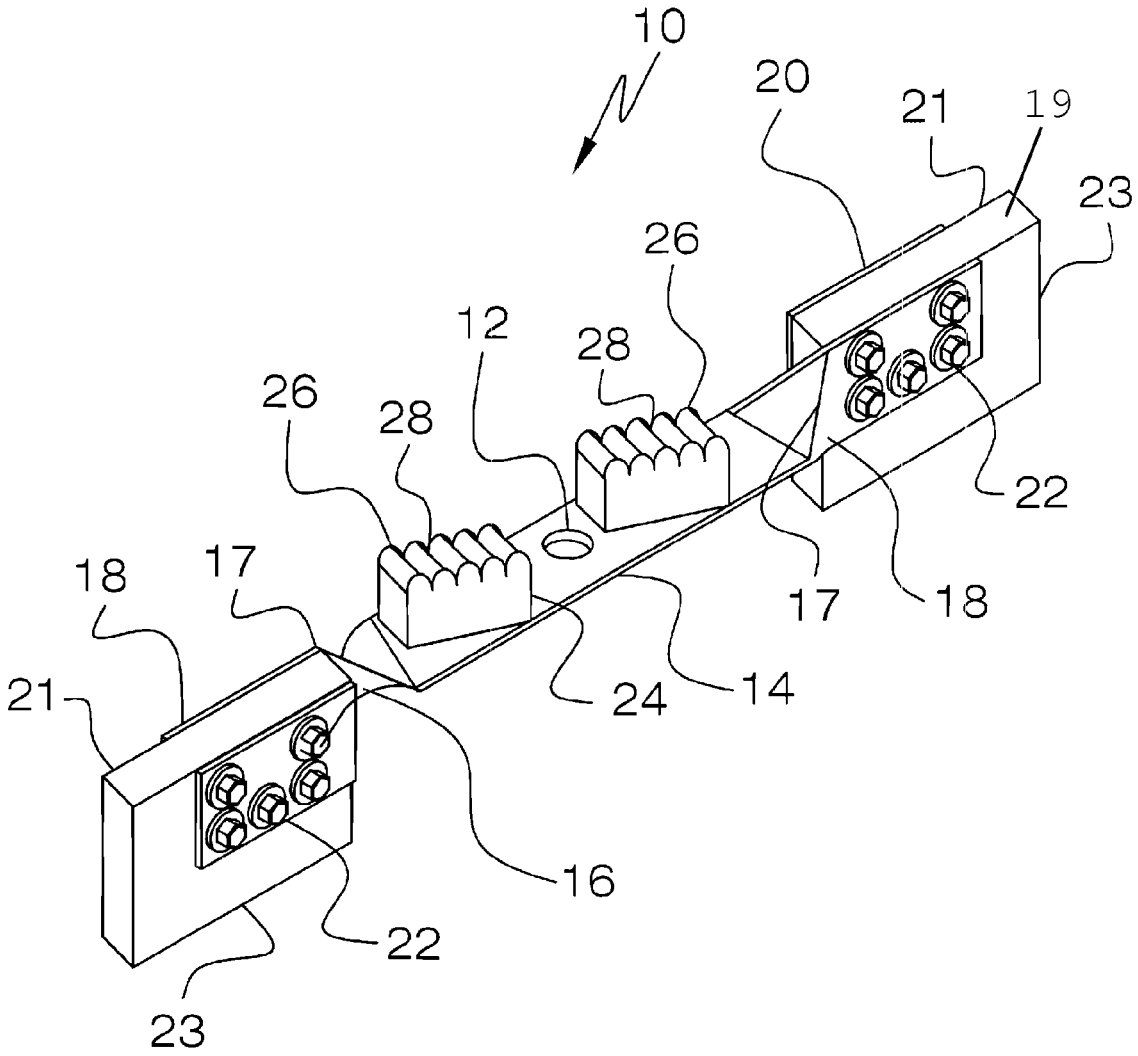
FIG. 3 is a top perspective view of the invention.
Figure 4:
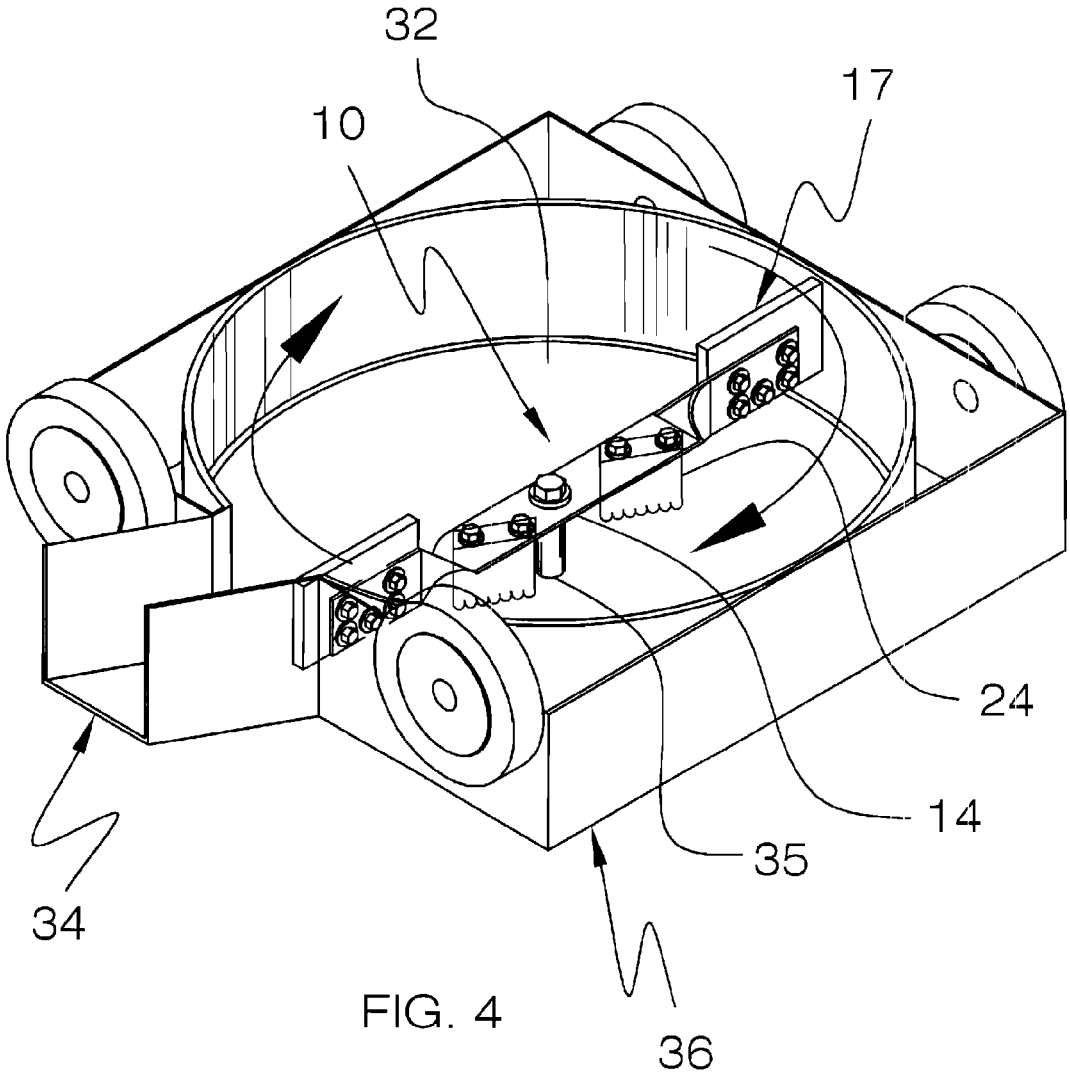
FIG. 4 is a bottom perspective view of the invention installed on a mower.

Referring to FIGS. 3 and 4, the invention 10 is for use with a rotary type lawn mower 30 having a wheeled housing 36 for movement over a surface 42 of operation. The lawn mower 30 has a side discharge chute 34. A motor 38 is mounted on the housing 36 in typical fashion. A crankshaft 35 extends into the housing 36. A deck 32 is on the underside of the housing 36. The invention 10 removably mounts on a lower end of the crankshaft 35 via the crankshaft mount 12. The invention comprises an elongated horizontal 14 that is coplanar to the deck 32 of the mower 30. An angle 16 is fixedly disposed at each end of the horizontal 14. The angle 16 smoothly transitions the horizontal 14 into a vertical end 17. The angle 16 thereby assists in lifting snow 40 from the surface 42. The pair of flexible spaced apart aerodynamic wipers 24 is mounted atop the horizontal 14. The wipers 24 extend upwardly therefrom. Each wiper 24 has a length and a width. Each wiper 24 is comprised of cloth-impregnated rubber. Each wiper 24 is disposed between the mount 12 and the angle 16. The length of each wiper 24 is at an angle to the length of the horizontal 12. Each wiper 24 comprises a plurality of rounded ribs 26. The ribs 26 are parallel to the width of the wiper 24. Each wiper 24 is further comprised of a plurality of indentions 28.

Each indention 28 is parallel to the width of the wiper 24. Each indention 28 separates two ribs. The wipers 24 aerodynamically remove snow 40 (FIG. 1) from the deck 32 of the mower 30. A pair of vertically mounted paddle plates 18 is provided. Each paddle plate 18 is affixed to the vertical end 17 of each angle 16. Each paddle 19 has a first side 21 and a second side 23. A portion of the first side 21 is mounted against the paddle plate 18. The paddle 19 extends downwardly therefrom toward the surface 42 of operation. A clamp plate 20 is affixed to the second side 23 of the paddle 19. A plurality of removable fasteners 22 removably holds the paddle 19 between the clamp plate 20 and the paddle plate 18. The paddles 19 and the wipers 24 are comprised of a cloth impregnated rubber.

Figure 1:
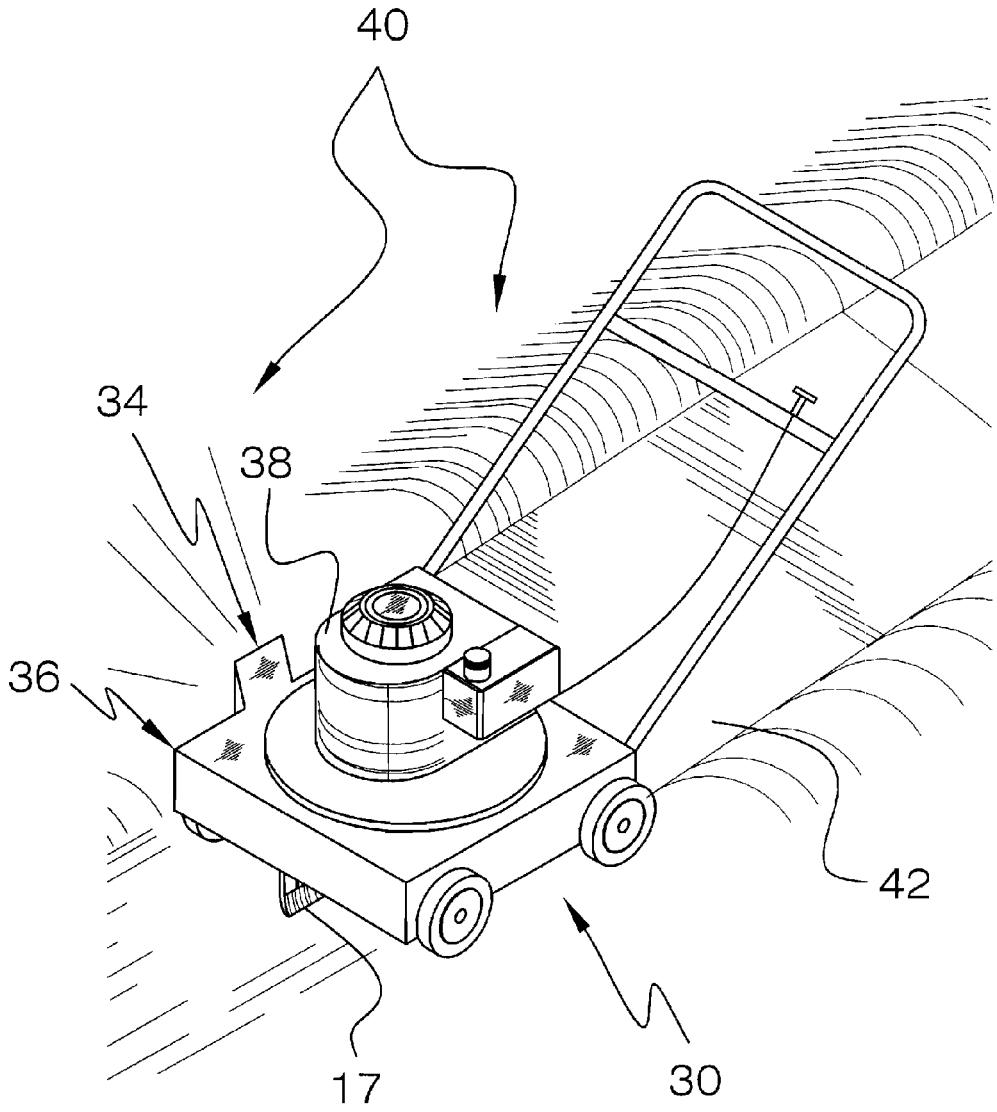
FIG. 1 is a perspective view of the invention installed and in use on a typical mower.
Figure 2:
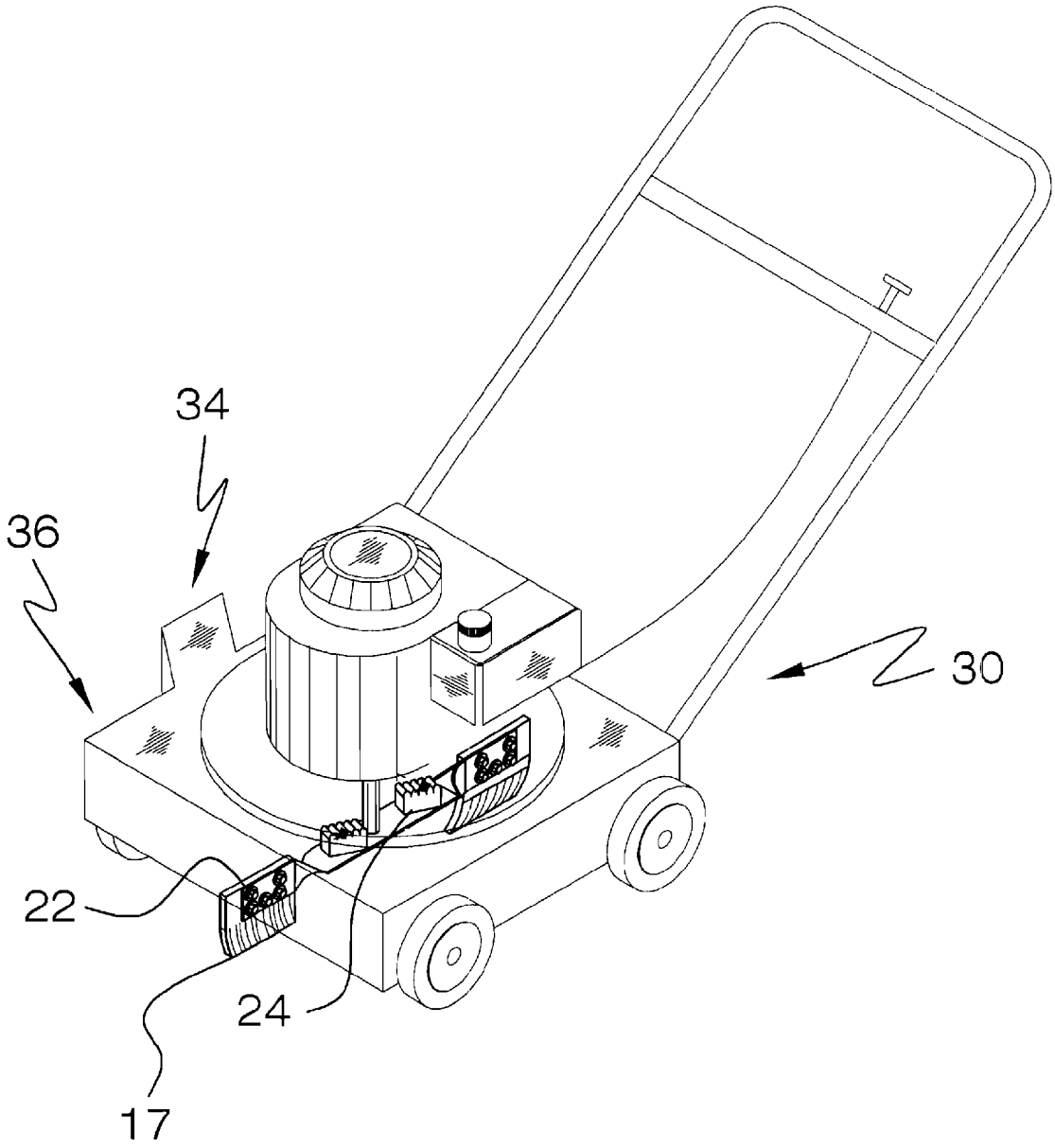
FIG. 2 is view of the invention installed on a typical mower, in place of the typical mower blade.

Referring to FIGS. 1 and 2, the rotation of the invention 10 clears snow 40 from the surface 42. Snow 40 within the housing 36 is aerodynamically prevented from accumulating on the deck 32 (FIG. 4) of the mower 30. Snow 40 is ejected out of the chute 34 of the lawn mower 30.

With respect to the above description then, it is to be realized that the optimum dimensional relationships for the parts of the snow mower blade, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Directional terms such as "front", "back", "in", "out", "downward", "upper", "lower", and the like may have been used in the description. These terms are applicable to the examples shown and described in conjunction with the drawings. These terms are merely used for the purpose of description in connection with the drawings and do not necessarily apply to the position in which the present invention may be used.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A snow mower blade, the blade for use with a rotary type lawn mower having a wheeled housing for movement over a surface of operation, the lawn mower having a side discharge chute and a motor mounted on the housing with a crankshaft extending into the housing, a deck on an underside of the housing, the blade for removably mounting on a lower end of the crankshaft, the blade comprising:

an elongated horizontal having a length and two opposite ends;

a crankshaft mount in a center of the horizontal, the mount for use in removably mounting the horizontal to the crankshaft of the lawn mower;

an angle at each end of the horizontal, wherein the angle smoothly transitions the horizontal into a vertical end, the angle thereby assisting in lifting snow from the surface;

a pair of flexible spaced apart aerodynamic wipers, each wiper having a length and a width, each wiper comprised of cloth-impregnated rubber, each wiper disposed between the mount and the angle, the wipers extending upwardly toward the deck, each wiper at an angle to the length of the horizontal, each wiper further comprising:

a plurality of rounded ribs, the ribs parallel to the width of the wiper;

a plurality of indentions, each indention parallel to the width of the wiper, each indention separating two ribs;

a pair of vertically mounted paddles plates, each paddle plate mounted to the vertical end of each angle;

a pair of paddles, each paddle having a first side and a second side, a portion of the first side against the paddle plate, the paddle extending downwardly therefrom toward the surface of operation;

a clamp plate, the clamp plate against the second side of the paddle;

a plurality of fasteners, each fastener holding the paddle between the clamp plate and the paddle plate, whereby rotation of the blade clears snow from the surface and ejects it out of the chute of the lawn mower.

2. The invention in claim 1 wherein the wipers are removable.

* * * * *